US011591825B2

(12) United States Patent
Kenny

(10) Patent No.: US 11,591,825 B2
(45) Date of Patent: Feb. 28, 2023

(54) DOOR LATCH

(71) Applicant: CAVITY SLIDERS LIMITED, Auckland (NZ)

(72) Inventor: Philip Richard Kenny, Auckland (NZ)

(73) Assignee: Cavity Sliders Limited, Auckland (NZ)

( * ) Notice: Subject to any disclaimer, the term of this patent is extended or adjusted under 35 U.S.C. 154(b) by 110 days.

(21) Appl. No.: 16/624,987

(22) PCT Filed: Jun. 21, 2018

(86) PCT No.: PCT/IB2018/054568
§ 371 (c)(1),
(2) Date: Dec. 20, 2019

(87) PCT Pub. No.: WO2019/003061
PCT Pub. Date: Jan. 3, 2019

(65) Prior Publication Data

US 2020/0141158 A1 May 7, 2020

(30) Foreign Application Priority Data

Jun. 26, 2017 (NZ) ..... 733247

(51) Int. Cl.

| | |
|---|---|
| ***E05B 65/08*** | (2006.01) |
| ***E05B 9/02*** | (2006.01) |
| ***E05B 15/02*** | (2006.01) |
| ***E05B 63/00*** | (2006.01) |
| ***E05B 63/04*** | (2006.01) |
| ***E05C 7/04*** | (2006.01) |
| ***E05C 19/16*** | (2006.01) |

(52) U.S. Cl.
CPC ..... *E05B 65/087* (2013.01); *E05B 9/02* (2013.01); *E05B 15/0205* (2013.01); *E05B 63/006* (2013.01); *E05B 63/042* (2013.01); *E05C 7/04* (2013.01); *E05C 19/163* (2013.01); *E05Y 2900/14* (2013.01)

(58) Field of Classification Search
CPC ... Y10T 292/0999; E05B 65/087; E05B 9/02; E05B 15/0205; E05B 63/006; E05B 63/042; E05C 7/04; E05C 19/163; E05Y 2900/14; Y10S 292/46
USPC ..... 292/251.5, 163, 177, 340; 49/449
See application file for complete search history.

(56) References Cited

U.S. PATENT DOCUMENTS 3,026,702 A * 3/1962 Cary ..... E05B 65/087 70/97
3,413,026 A 11/1968 Kendrick et al.
3,599,452 A 8/1971 Yokohama et al.
(Continued)

FOREIGN PATENT DOCUMENTS

CA 2654038 A1 * 12/2007 ..... E05B 47/0038
CA 2654038 A1 12/2007
(Continued)

*Primary Examiner* — Christine M Mills
*Assistant Examiner* — Steven A Tullia
(74) *Attorney, Agent, or Firm* — Dann, Dorfman, Herrell and Skillman, P.C.

(57) ABSTRACT

A sliding door handle and strike assembly includes a locking member for engaging the strike to prevent the door from opening. The locking member is biased to an unlocked position, until it is moved into a locking position, in which magnetic co-operation acts to hold the locking member in the locking position.

20 Claims, 5 Drawing Sheets

(56) References Cited

U.S. PATENT DOCUMENTS 3,744,833 A * 7/1973 Berducone ..... E05B 47/0038 292/251.5
4,026,588 A * 5/1977 Bisbing ..... E05C 19/165 292/251.5
4,194,771 A * 3/1980 Biggs ..... E05C 19/16 292/251.5
4,480,862 A * 11/1984 Fleming ..... E05B 65/087 292/150
D303,754 S * 10/1989 Weinerman ..... E05B 65/087 D8/344
5,152,561 A * 10/1992 Engebretson ..... E05B 65/087 292/145
5,362,116 A 11/1994 Doyle et al.
5,542,720 A * 8/1996 Fleming ..... E05B 63/20 292/32
5,676,408 A * 10/1997 Davidian ..... E05B 65/0811 292/197
6,443,504 B1 * 9/2002 Donald ..... G06K 9/00087 292/109
6,902,214 B2 6/2005 Smith
8,938,998 B2 * 1/2015 Haber ..... E05C 3/045 70/276
9,394,732 B1 7/2016 Ahmad
2004/0227349 A1 11/2004 Denys
2005/0210938 A1 * 9/2005 Doyle ..... E05C 19/163 70/276
2005/0225098 A1 * 10/2005 Kliefoth ..... E05C 19/163 292/251.5
2006/0082166 A1 * 4/2006 Lawrence ..... E05B 15/10 292/337
2006/0174455 A1 * 8/2006 Saitoh ..... E05B 67/003 24/303
2006/0175842 A1 * 8/2006 Saitoh ..... E05C 19/163 292/251.5
2008/0296915 A1 12/2008 Clark et al.
2009/0115204 A1 * 5/2009 Rycroft ..... E05B 63/20 70/276
2012/0248793 A1 * 10/2012 Fiedler ..... A44B 11/2592 70/330
2012/0291359 A1 * 11/2012 Hans ..... E05B 5/003 49/404
2014/0054904 A1 * 2/2014 Andrews ..... E05C 19/163 292/144
2014/0319850 A1 * 10/2014 Berger ..... E05C 19/163 292/177

FOREIGN PATENT DOCUMENTS

DE 2430911 A1 * 1/1976 ..... E05B 65/087
DE 20221015 U1 12/2004
DE 102007041402 A1 * 3/2009 ..... E05B 65/087
DE 202008003477 U1 * 7/2009 ..... E05B 47/0012
EP 1308588 A1 * 5/2003 ..... E05B 65/087
EP 1693538 A1 8/2006
GB 685404 A 1/1953
GB 2124692 A * 2/1984 ..... E05B 65/087
GB 2134590 A * 8/1984 ..... E05B 15/022
GB 2187784 A * 9/1987 ..... E05B 65/087
GB 2214223 A * 8/1989 ..... E05B 15/0006
GB 2440477 B 11/2009
GB 2510470 B 12/2015
JP 03295988 A 12/1991
JP 2000145249 A 5/2000
JP 2003278438 A 10/2003
JP 2004137736 A 5/2004
WO 2005078218 A1 8/2005
WO WO-2014044850 A1 * 3/2014 ..... E05B 5/006
WO WO-2014060887 A2 * 4/2014 ..... E05B 65/08
WO 2015015405 A1 2/2015

* cited by examiner

DOOR LATCH

FIELD OF THE INVENTION

The present invention relates to improved door handles and/or latching door handles. In particular the invention relates to latching door handles suitable for use with sliding doors.

BACKGROUND

Door handles for sliding doors are generally well known in the art. However, for sliding door handles and particularly interior latching sliding doors handles operated via a snib, it is common that the latch and/or strike can be damaged if the latch/snib is moved into a locked position (while the door is open), and then the door is closed (or slammed) on to the latch mechanism.

Further, it is considered desirable for such door hardware to be aesthetically pleasing, and this often means that door hardware should be simple, sleek, and not adorned with multiple obtrusive functional features that may detract from the aesthetic of the hardware.

It is an object of the present invention to provide an improved sliding door latch that will ameliorate one or more of the abovementioned disadvantages or that will at least provide the public with a useful choice.

SUMMARY OF THE INVENTION

In a first aspect the invention broadly comprises a sliding door handle and latch assembly for latching onto a strike comprising:

a front face plate substantially parallel with a closing edge of a sliding door to which said assembly is mounted, said front face including an aperture therein adapted to receive said strike when said door is closed, a locking member moveable between an unlocked position wherein said locking member is located out of a pathway along which said strike enters said aperture when said door is closed, and a locked position wherein said locking member engages with said strike to prevent said door from opening, and wherein said locking member is biased into said unlocked position, and wherein said strike and a locking actuator are configured to co-operate magnetically such that said magnetic co-operation holds said locking member in said locked position against said bias.

According to another aspect said front face plate of said latch assembly is substantially aligned with said closing edge of said sliding door.

According to another aspect said aperture is sufficiently large to allow a user's finger to enter it such that it can operate as a finger pull, to move said door in a closing direction.

According to another aspect said biasing member is a spring.

According to another aspect said locking member is moveable via a snib member, into said locked position.

According to another aspect said snib member is accessible from a side of said door.

According to another aspect said handle assembly further includes a side member substantially aligned and parallel to a side face of said door, and said side member of said handle assembly includes an aperture recess adapted for a user to engage, and said snib is located in said aperture recess.

According to another aspect said assembly includes two said side members, each substantially aligned and parallel to a respective side face of said door, and said side members of said handle assembly include an aperture recess adapted for a user to engage, and at least one aperture recess includes said snib.

According to another aspect the other of said aperture recess includes an emergency access snib.

According to another aspect said side member is mounted to said door via a plurality of fasteners.

According to another aspect said side members include flange portions depending therefrom, and fasteners are fixed into a front edge surface of said door via said flanges, to mount said side members rigidly to said door.

According to another aspect said front face is separate from said side members, such that said side members are moveable to accommodate different width doors.

According to another aspect said front face plate is part of a locking sub-assembly, further including said locking member and a member biasing said locking member into said unlocked position.

According to another aspect said locking sub-assembly is fixed independently of said fasteners associated with said side members.

According to another aspect at least outside faces of said side members are symmetrical such that each can be used on an alternative side of said door.

According to another aspect wherein, in order to be used on an alternative side of said door, each side member need be rotated by 180 degrees.

According to another aspect said movement of said locking member between said unlocked position and said locked position, is linear.

According to another aspect said linear movement is substantially vertical.

According to another aspect said strike includes a base adapted to mount to a door jamb or an adjacent door, and a protruding portion extending from said base toward said door, and said protruding portion includes a barb portion defining an engagement surface adapted to interact with said locking member to prevent said door from separating from said strike when said locking member is in said locking position.

According to another aspect said locking actuator is a magnet.

According to another aspect said locking member is of a non-magnetic material.

According to another aspect said locking member and said locking actuator are integral with each other.

According to another aspect said locking actuator is of a ferro-magnetic material, and said strike includes at least a magnetic component associated with it.

According to another aspect said magnetic co-operation between said strike and said locking actuator member is insufficiently strong to move said locking member from an unlocked position into a locked position, when said strike enters said aperture when said door is closed.

According to another aspect said magnetic co-operation between said strike and said locking actuator member is sufficiently strong to move said locking member from an unlocked position into a locked position, when said strike enters said aperture when said door is closed.

According to another aspect said strike is mounted directly or indirectly to an adjacent door in a bi-parting configuration.

According to another aspect the invention broadly comprises a sliding door handle and latch assembly substantially as herein described with reference to any one or more of the accompanying drawings.

The term 'comprising' as used in this specification and claims means 'consisting at least in part of'. When interpreting statements in this specification and claims which include the term 'comprising', other features besides the features prefaced by this term in each statement can also be present. Related terms such as 'comprise' and 'comprised' are to be interpreted in a similar manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

As used herein the term '(5)' following a noun means the plural and/or singular form of that noun.

As used herein the term 'and/or' means 'and' or 'or', or where the context allows both.

The invention consists in the foregoing and also envisages constructions of which the following gives examples only.

BRIEF DESCRIPTION OF THE DRAWINGS

The present invention will now be described by way of example only and with reference to the accompanying drawings in which.

DETAILED DESCRIPTION

As will be described in detail in the following description, the present door handle assembly preferably provides a handle assembly comprising components that are easy to manufacture, as this can be a significant factor in the cost to the consumer. Similarly, the components and/or handle assembly are preferably easy to assemble, and also preferably easy to install on site. Other advantages of the preferred configurations will also make themselves apparent.

Figure 1:
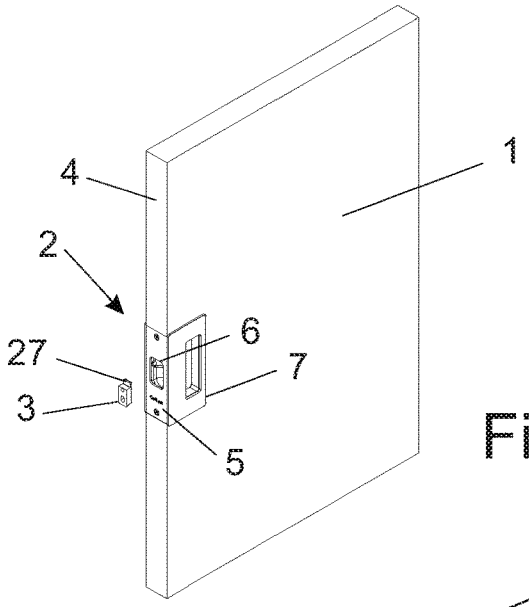
FIG. 1 shows a perspective view of a door into which a handle assembly according to one preferred configuration is installed.

With reference to FIG. 1, there is shown a door 1 having a handle assembly 2 mounted thereon. Door 1 is a sliding door and as such only moves substantially in the plane of the door 1, on a track (not shown for simplicity). Such sliding door track systems are well known in the art, and for the avoidance of doubt may also include side-by-side sliding doors in an 'overtaking door' configuration.

The door 1, includes a door edge 4 which when closed preferably abuts flush with a closing door jamb (not shown). Alternatively, as will be described in more detail later, some configurations may abut another adjacent door sliding in the same plane (rather than a door jamb), if used in a bi-parting door configuration.

Front plate 5 of the handle assembly 1 includes an aperture 6. In the most preferred configurations the aperture 6, performs two functions being firstly to receive a strike 3, and secondly to act as a finger pull to allow a user to pull the door in a closing direction.

The function of a finger pull, is particularly useful where the door 1 is installed in a pocket door system, because when fully open, only the front edge 4 of the door 1 is typically user accessible. Accordingly, it is preferred that the size of the aperture 6 is sufficient for a user to put a finger tip through to engage the front plate 5, and thereby grip the door 1 to assist in pulling from the pocket. The dual use of aperture 6, helps contribute to the desirable aesthetic of the handle assembly 2.

Alternatively, the front face plate 5 may include separate apertures to perform each of the functions of receiving a strike and acting as a finger pull. Alternatively still, there are known pull latches that can be extended to retrieve the door 1 when desired, or other method.

With further reference to FIG. 1, the strike 3 is shown in alignment with aperture 6 such that when door 1 is fully closed, the strike 3 enters the aperture 6. Preferably, the aperture 6 is sufficiently deep to receive the entire strike 3. It may also be preferred that the strike 3 does not touch the front plate 5, as this can leave marks over time.

Figure 2:
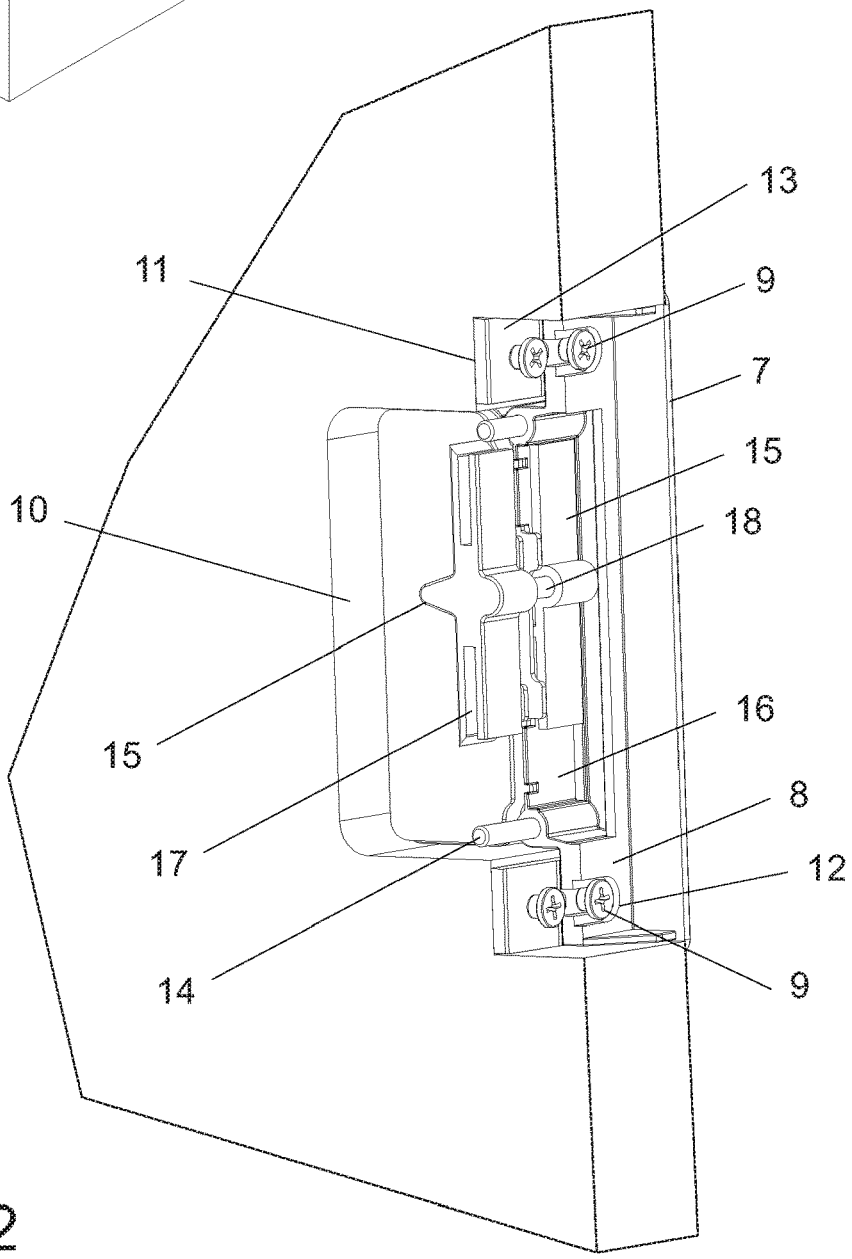
FIG. 2 shows a partial cut-away perspective view of the handle assembly of FIG. 1, having the near side plate and front plate locking sub-assembly removed.

With reference to FIG. 2, the handle assembly 2 is shown with the near side handle plate 7, and front face plate 5 removed, to show aspects of the inner workings of the preferred assembly. In this view it can be seen that the side plates 7 are mounted into a cut-out 10, in door 1. In particular, the cut-outs 10 also preferably include rebate portions 11 (at top and bottom) to receive the side plates 7. The side plates 7 include flange portions 8 extending across a portion of the front edge of the door width, and include apertures and/or slots 12 through which fasteners 9, fix the side plates 7, to the door 1.

It is preferred that mounting wedges 13, are provided between rebate portions 11 and the mounting flanges 8. In particular, mounting wedges 13 include angled front facing surfaces that mate with the rear surface of the mounting flanges 8. This angled surface is configured to pull the distal edges of the handle side plates 7 towards the door surface as the fasteners 9 are tightened. It has been found that an angle of a few degrees (away from the front face normal) is preferred. The wedges preferably have mirrored angled surfaces to mate with respective side handle plates on each side of the door 1. The wedges may be made from a polymer material, or alternatively a metallic material.

In most applications the face plate 5, and side plate 7 are preferably metal components such as stainless steel, brass, copper, painted or powder coated metal, or other suitable material.

In order to ensure alignment between respective halves of the handle plates 7, alignment features are preferably provided. It is preferred that any alignment features are not 'handed' (i.e. not requiring a left hand version and a right hand version). That is, it is preferred that the side plates are identical so that the same tool can be used to produce the parts for each side and/or the same part can be used on each side (by simply turning the part over). This feature (if present), also means that ordering mistakes are eliminated where a customer may order a left hand closing product, when they actually need a right hand closing product. It will be appreciated by those skilled in the art that other 'non-handed' patterns of alignment features may be adopted, for example patterns of male and female features.

For example, as shown in FIG. 2, alignment pins 14 are placed in respective apertures provided on side plates 7. It will be appreciated that pins 14 when engaged with apertures in the opposite side plate 7 (not shown) will complete alignment.

With further reference to FIG. 2, a snib 15 is shown moveably mounted on rails 16 so slots 17 engage with rails 16 to allow the snib 15 to be moved up and down (shown in its uppermost position) in a substantially vertical direction. As shown in FIG. 2, it is preferred that each handle plate flange includes a moveable snib member 15. However, as will be described in more detail later, the moveable snib members 15 may take any of a number of forms (and may or may not function as a snib).

Where a snib 15 is provided on both sides of the handle assembly 2, a snib pin 18 may be provided in order to couple the respective snibs together.

The width of the handle plate flanges 8 may preferably extend less than (or equal to) half the width of the door 1. It will be appreciated that in this configuration, the handle plates 7 may accommodate fixing to variable widths of door 1 (without modification). This feature allows the same parts to be adapted for different door widths without needing different sized components. To this effect it is preferred that the alignment features allow for movement of the handle plate components 7 in a direction out of plane with door 1 in order to accommodate different door widths.

Figure 3:
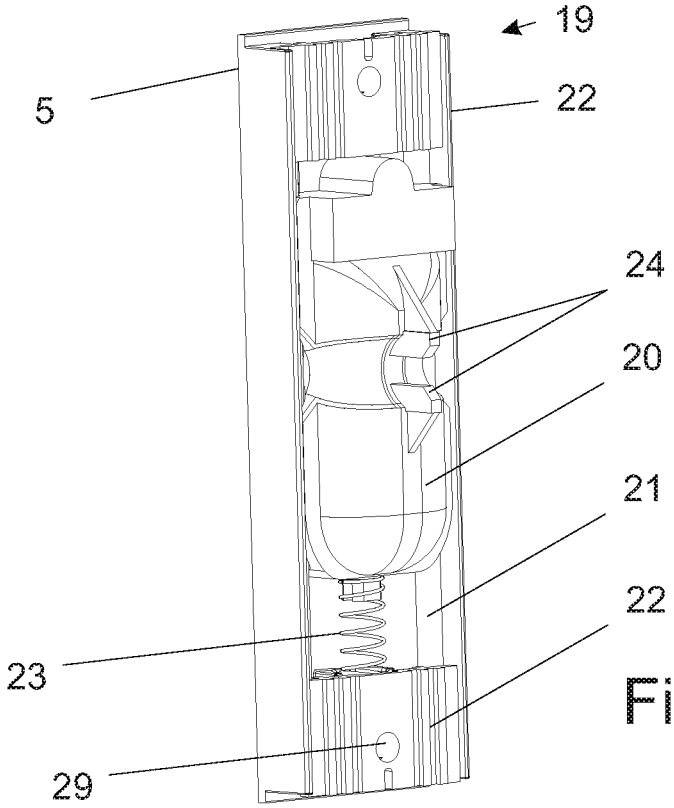
FIG. 3 shows a rear view of a preferred locking sub-assembly.
Figure 6:
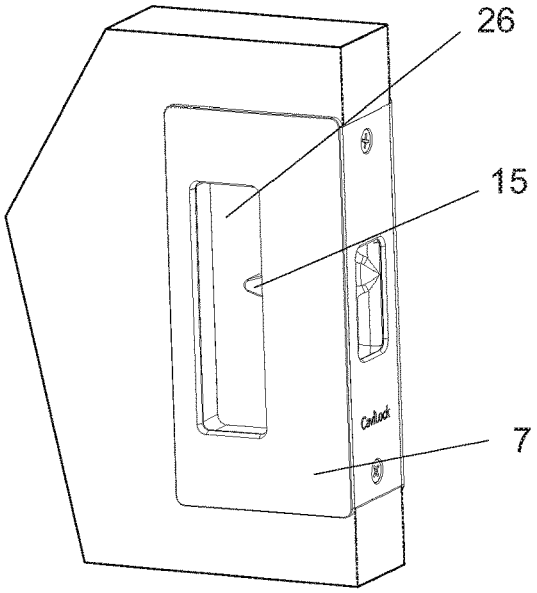
FIG. 6 shows the handle assembly of FIG. 2, having the near side plate and front plate in place.

With reference to FIG. 3, a locking sub-assembly 19 is shown mounted on the rear of front face plate 5. It is preferred that this sub-assembly 19 is separable and engagable with the mounted handle plates 7, and snib assembly as shown in FIG. 2. In order to mount the locking sub-assembly 19, a plurality of fastener apertures 29 are provided as shown in FIG. 6 assembled.

It is preferred that all fasteners are fitted into the edge of the door 1, so that there are no fasteners visible from the sides of the handle assembly. As a result no fasteners are visible when the door 1 is closed.

Finger shroud 20 is preferably part of the locking sub-assembly 19 and moveably mounted with respect to front face plate 5, by sliding vertically on guide rods 21. Guide rods 21 are fixed to the front face plate 5 via guide rail blocks 22. A spring 23 biases finger shroud 20 upwards (into an unlocked position). The rear surface of finger shroud 20 is provided with engaging features 24 which (when assembled) engaged with snib pin 18 such that movement of the snib 15 is coupled to movement of the finger shroud 20.

Figure 4:
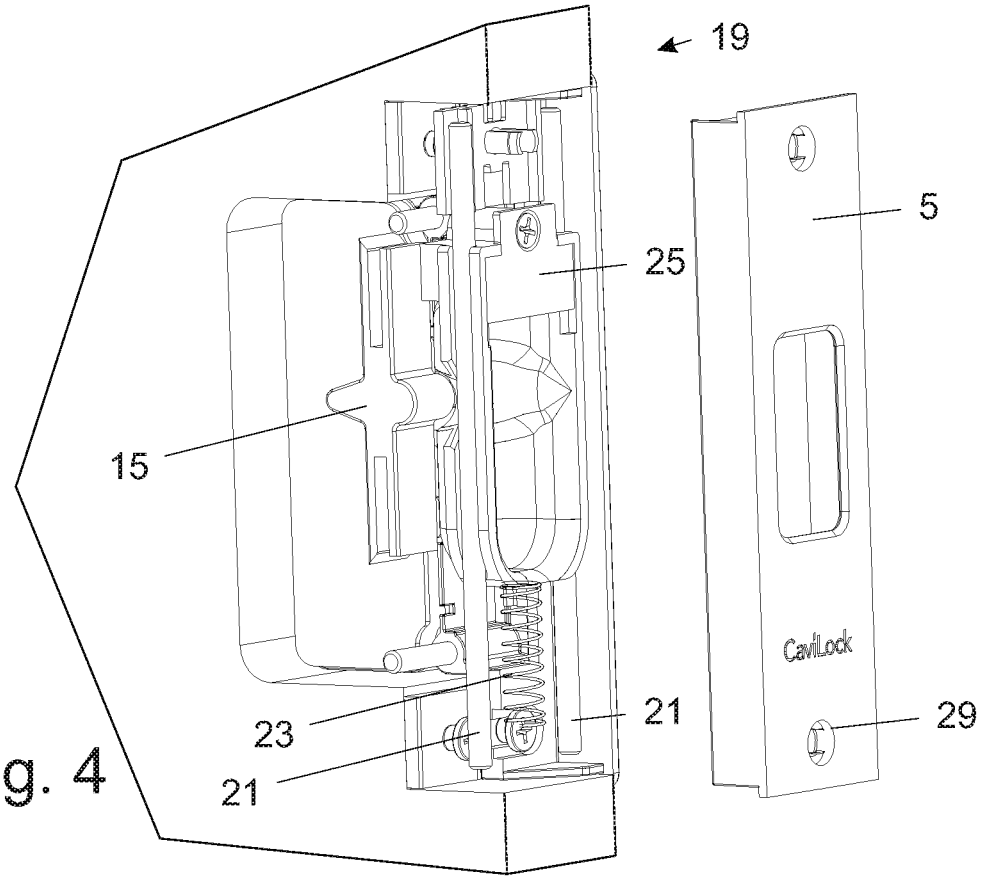
FIG. 4 shows a partial cut-away perspective view of the handle assembly of FIG. 1, having the front plate removed to reveal parts of the locking sub-assembly.

With particular reference to FIG. 4, the handle assembly is shown with a locking sub-assembly 19 in situ, but with the front face plate 5 removed. In this view, the finger shroud 20 is shown coupled to snibs 15 which are moveable along guide rods 21, and are shown biased into an unlocked position by spring 23. The finger shroud 20 in this configuration is part of a locking sub-assembly 19. However, it is to be appreciated that the locking sub-assembly 19 may not necessarily include a finger shroud 20 that is moveable with the locking sub-assembly 19.

Figure 5:
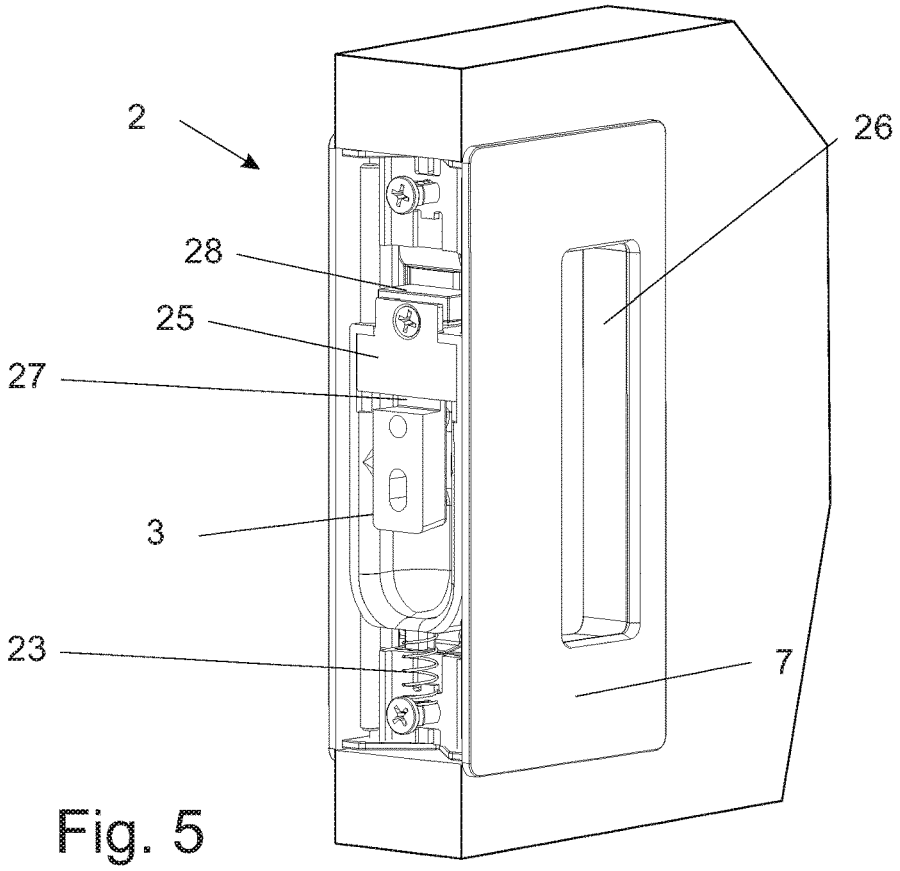
FIG. 5 shows a partial cut-away perspective view of the handle assembly of FIG. 4, including a strike and with the locking member in a locked position engaged with the strike.

With reference to FIG. 5 the handle assembly 2 is shown engaged with a strike 3. In order to reach this position in use, the door 1 has been closed until the strike 3 has been received within front plate aperture 6. Subsequently, a user can manipulate the snib 15 (located in a recess 26 of side plate 7), in order to translate the locking assembly downwards, against the bias of spring 23. In this position locking member 25 is positioned in the pathway of the strike 3, such that locking member 25 engages with barb portion 27 of strike 3, preventing the door 1 from being opened.

In order to retain the locking sub-assembly 19 in the locking position (as shown in FIG. 5), a magnet locking actuator 28 is provided. Magnet 28 co-operates with strike 3 such that attraction between the two, holds the locking sub-assembly 19 in a locked position against the bias of spring 23 which would otherwise unlock the assembly (when the snib was released).

In this configuration, it is preferred that locking member 25 is of a non-magnetic (or non-ferro-magnetic) material. Preferably in this configuration the lock is configured such that the magnetic attraction between the locking assembly 19 and strike 3, is insufficient to move the locking assembly from an unlocked position to, a locked position. That is, in this configuration, the assembly cannot be locked without a user manipulating the snib, which when moved to the locking position, the magnetic attraction keeps the door locked.

Accordingly, without manipulation of the snib 15, the door 1 can be closed (or slammed) onto the strike without causing any damage due to the spring 23 biasing the locking mechanism into an unlocked position and out of a contact pathway with the snib 15. However, the locking sub-assembly 19 is only held in a locking position when the door is closed on the strike 3, and a user manipulates the snib 15, bringing the magnet actuator close enough to the strike in order to hold the locking member against the bias of spring 23.

Although in the above configuration the locking assembly includes magnet 28, and snib 15 made of a ferro-magnetic material, in order that they co-operate to be attracted to each other, it will be appreciated that the arrangement may be reversed, or alternatively still, both may include magnetic elements in order to provide the required attraction.

In another configuration, it may be desirable that the handle assembly 2 is configured to automatically lock on closing. This alternative configuration can be achieved by changing the relative strength between spring 23 and the attraction between the locking sub-assembly 19 and strike 3. For example, the attraction may be sufficiently strong such that when the door is closed on a strike 3, the spring 23 is overpowered and the locking member 25 is pulled downwards to engage with the strike. In this configuration a user must manipulate the snib 15 in order to unlock the locking member 25 from the snib 15 in order to open the door.

As the door is opened, the distance between the locking sub-assembly 19 and snib 15, becomes sufficient to reduce the attraction and allow the spring 23 to bias the locking assembly 19 into an unlocked position. This prevents damage to the locking member as the door is closed onto the snib, by maintaining the locking member in an unlocked position until the door is fully closed.

With reference to FIG. 6, the snib 15 is shown accessible in a recess 26 of handle plate 7. It will be appreciated that different configurations may be desirable, where each side of the handle may require a different snib configuration. The present handle 2, provides a very easy way to simply change the snib member 15, to alter the utility of the handle.

Some example configurations will now be summarised with reference to FIG. 7 to FIG. 11. It will be understood that each, may be used on one or both sides of the handle according to user requirements. The following are simply examples.

Figure 7:
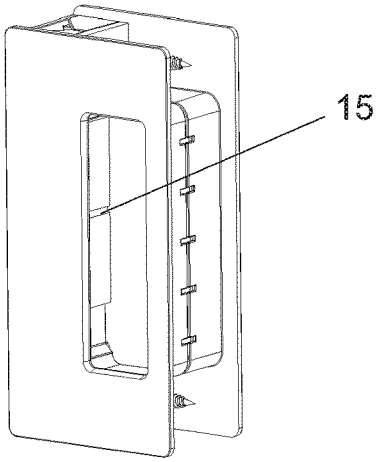
FIG. 7 shows a perspective view of an alternative handle assembly including an emergency snib configuration.

FIG. 7 shows an emergency type snib 15, that may be used on at least one side of the handle (likely in combination with any other snib style). The emergency snib 15 would be common for a privacy configuration where a normal snib is used on the inside, and an emergency snib on the outside that can be used with a tool to engage the emergency snib, but is not easy to override with fingers alone.

Figure 8:
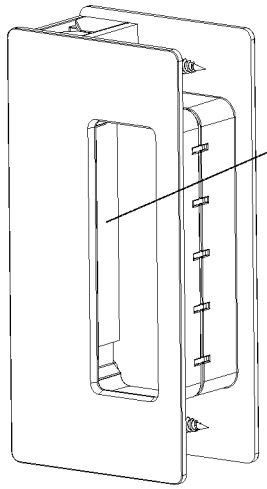
FIG. 8 shows a perspective view of an alternative handle assembly including a blanking snib configuration.

FIG. 8 shows a blanking snib 15, which may be used where no locking/unlocking action is required. This may be on one side of the door or alternatively both.

Figure 9:
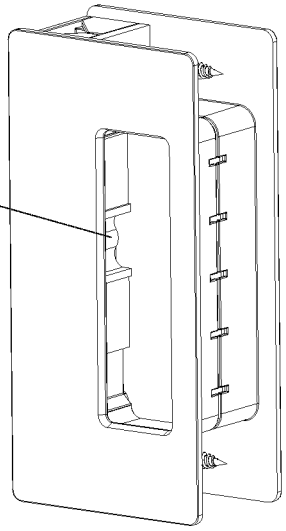
FIG. 9 shows a perspective view of an alternative handle assembly including a hidden snib configuration.

FIG. 9 shows a hidden snib 15, that can be manipulated by a user relatively easily, but provides a very unobtrusive aesthetic.

Figure 10:
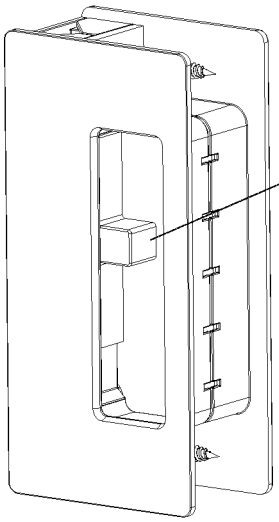
FIG. 10 shows a perspective view of an alternative handle assembly including an alternative small snib configuration.

FIG. 10 shows an alternative snib 15.

Figure 11:
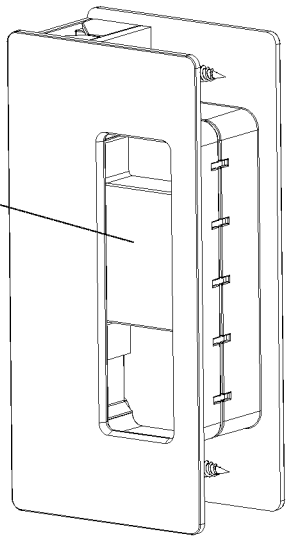
FIG. 11 shows a perspective view of an alternative handle assembly including an alternative large snib configuration.

FIG. 11 shows another alternative snib 15, that is larger and may be easier to manipulate. This may be more appropriate for younger children, elderly adults, or people with disabilities that affect fine motor control.

Figure 12:
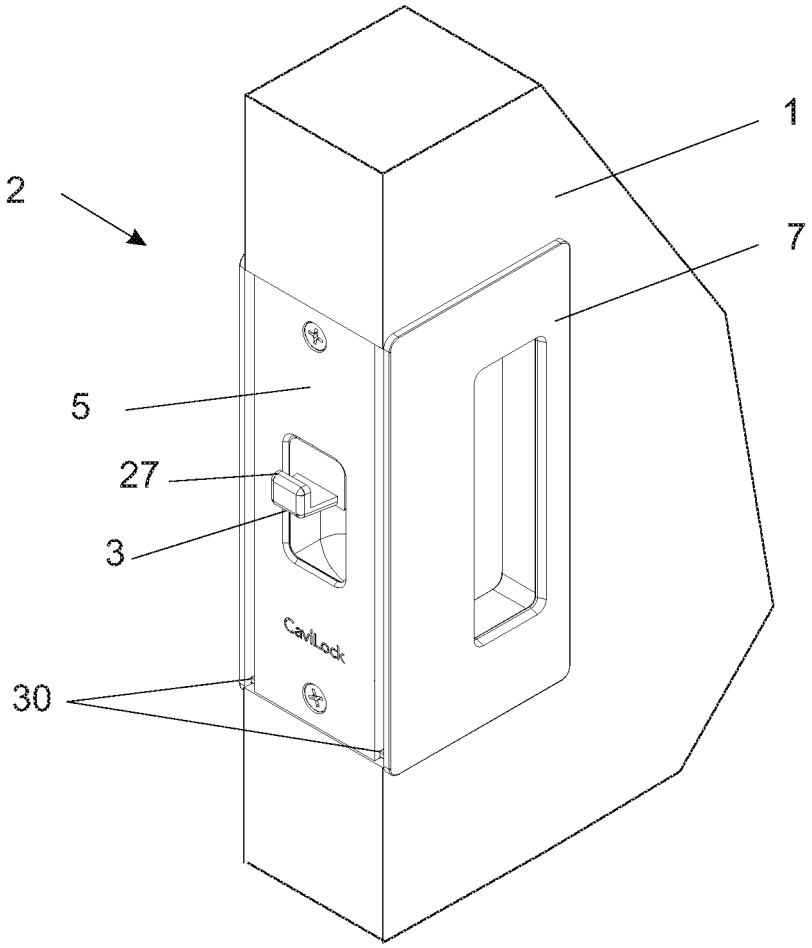
FIG. 12 shows a perspective view of an alternative handle assembly mounted in a wider door and including a strike for engaging with a handle in an adjacent door in a bi-parting configuration.

With reference to FIG. 12, a handle 2 is shown mounted to a wider door 1. In this configuration it can be seen that small gaps 30 open up between the front plates 5, and side plates 7. The flange portions 8 of side plates 7 (not visible), cover the door beneath the gaps 30, to present a solid looking handle. It has been found that door widths up to around 6 mm wider (presenting a 3 mm gap on each side), are more than acceptable and it is difficult to detect the variation.

Accommodation of larger gaps are possible, but it is preferred that wider front plates 5 are used to optimise the aesthetic look of the handle.

With further reference to FIG. 12, the handle 2 includes a strike 3. This handle is intended as a matching pair for a bi-parting door configuration, in which the handle shown in FIG. 12, interacts with a handle as described earlier.

The invention claimed is:

1. A sliding door and latch assembly for latching onto a strike comprising:

a front face plate substantially parallel with a closing edge of a sliding door to which said assembly is mounted, said front face including an aperture therein receiving said strike when said sliding door is closed, a locking member moveable between an unlocked position wherein said locking member is located completely out of a pathway along which said strike enters said aperture during closing of said door, and a locked position wherein said locking member engages with said strike to prevent said door from opening, and wherein said locking member is biased into said unlocked position, and wherein said strike and said locking member are configured to co-operate magnetically such that said magnetic co-operation moves and holds said locking member into said locked position against said bias, when said sliding door is closed and a user manipulable locking actuator is in a locked position.

2. A sliding door and latch assembly as claimed in claim 1, wherein said front face plate of said latch assembly is substantially aligned with said closing edge of said sliding door.

3. A sliding door and latch assembly as claimed in claim 1, wherein said aperture is sufficiently large to allow a user's finger to enter it such that it can operate as a finger pull, to move said door in a closing direction.

4. A sliding door and latch assembly as claimed in claim 1, wherein said biasing member is a spring.

5. A sliding door and latch assembly as claimed in claim 1, wherein said user manipulable locking actuator is a snib member, adapted to move said locking member sufficiently close to said strike, when said door is closed, such that said magnetic cooperation moves and holds said locking member in said locked position.

6. A sliding door and latch assembly as claimed in claim 5, wherein said handle assembly further includes a side member substantially aligned and parallel to a side face of said door, and said side member of said handle assembly includes an aperture recess adapted for a user to engage, and said snib is located in said aperture recess.

7. A sliding door and latch assembly as claimed in claim 6, wherein said assembly includes two said side members, each substantially aligned and parallel to a respective side face of said door, and said side members of said handle assembly include an aperture recess adapted for a user to engage, and at least one aperture recess includes said snib.

8. A sliding door and latch assembly as claimed in claim 7, wherein said side members are mounted to said door via a plurality of fasteners, and wherein said side members include flange portions depending therefrom, and fasteners are fixed into a front edge surface of said door via said flanges, to mount said side members rigidly to said door.

9. A sliding door and latch assembly as claimed in claim 8, wherein said front face is separate from said side members, such that said side members are moveable to accommodate different width doors.

10. A sliding door and latch assembly as claimed in claim 9, wherein said front face plate is part of a locking sub-assembly, further including said locking member and a member biasing said locking member into said unlocked position, and wherein said locking sub-assembly is fixed independently of said fasteners associated with said side members.

11. A sliding door and latch assembly as claimed in claim 6, wherein at least outside faces of said side members are symmetrical such that each can be used on an alternative side of said door.

12. A sliding door and latch assembly as claimed in claim 1, wherein said movement of said locking member between said unlocked position and said locked position, is linear.

13. A sliding door and latch assembly as claimed in claim 1, wherein said strike includes a base adapted to mount to a door jamb or an adjacent door, and a protruding portion extending from said base toward said door, and said protruding portion includes a barb portion defining an engagement surface adapted to interact with said locking member to prevent said door from separating from said strike when said locking member is in said locking position.

14. A sliding door and latch assembly as claimed in claim 1, wherein said locking actuator is a magnet.

15. A sliding door and latch assembly as claimed in claim 1, wherein said locking member is of a non-magnetic material.

16. A sliding door and latch assembly as claimed in claim 1, wherein said locking member and said locking actuator are integral with each other.

17. A sliding door and latch assembly as claimed in claim 1, wherein said locking actuator is of a ferro-magnetic material, and said strike includes at least a magnetic component associated with it.

18. A sliding door and latch assembly as claimed in claim 1, wherein said magnetic co-operation between said strike and said locking actuator member is insufficiently strong to move said locking member from an unlocked position into a locked position, when said strike enters said aperture when said door is closed.

19. A sliding door and latch assembly as claimed in claim 1, wherein said magnetic co-operation between said strike and said locking member is insufficiently strong to move said locking member into a locked position, when said strike enters said aperture when said door is closed, when said user manipulable locking actuator is in an unlocked position.

20. A sliding door and latch assembly as claimed in claim 1, wherein said strike is mounted directly or indirectly to an adjacent door in a bi-parting configuration.

* * * * *